US010297174B2

(12) United States Patent
Amin

(10) Patent No.: US 10,297,174 B2
(45) Date of Patent: May 21, 2019

(54) VISUAL ADVERTISEMENT ASSEMBLY

(71) Applicant: Bipin Amin, Fortmill, SC (US)

(72) Inventor: Bipin Amin, Fortmill, SC (US)

( * ) Notice: Subject to any disclaimer, the term of this patent is extended or adjusted under 35 U.S.C. 154(b) by 25 days.

(21) Appl. No.: 15/625,010

(22) Filed: Jun. 16, 2017

(65) Prior Publication Data

US 2018/0366042 A1 Dec. 20, 2018

(51) Int. Cl.

| | |
|---|---|
| ***G09F 9/00*** | (2006.01) |
| ***G09F 9/302*** | (2006.01) |
| ***G09F 21/02*** | (2006.01) |
| ***G09F 9/33*** | (2006.01) |

(52) U.S. Cl.

CPC ..... *G09F 9/302* (2013.01); *G09F 9/33* (2013.01); *G09F 21/026* (2013.01)

(58) Field of Classification Search

CPC ..... G09G 3/04; G09G 3/30; G09G 3/3266; G09G 3/20; G09F 9/302; G09F 9/33; G09F 21/026

See application file for complete search history.

(56) References Cited

U.S. PATENT DOCUMENTS 373,387 A 11/1887 Butler
5,767,818 A * 6/1998 Nishida ..... G09F 9/307 345/1.1
6,593,902 B1 * 7/2003 Ogino ..... G06F 3/1446 345/1.1
D647,286 S 10/2011 Malck
2002/0005826 A1 1/2002 Pederson
2002/0039084 A1 * 4/2002 Yamaguchi ..... G06F 19/00 345/1.1
2003/0103018 A1 * 6/2003 Yokota ..... G09G 3/3622 345/59
2003/0167666 A1 9/2003 Close, Jr.
2003/0223210 A1 12/2003 Chin
2007/0193089 A1 8/2007 Hadaya
2007/0279322 A1 * 12/2007 Good ..... G09F 9/33 345/46
2010/0095431 A1 4/2010 Liao

* cited by examiner

*Primary Examiner* — Cassandra Davis

(57) ABSTRACT

A visual advertisement assembly includes a sign that may be displayed. A plurality of light emitters is provided and each of the light emitters is coupled to the sign. Each of the light emitters selectively emits light and the light emitters are arranged into a plurality of sets of light emitters. A plurality of controllers is provided and each of the controllers is coupled to the sign. Each of the controllers is electrically coupled to an associated one of the sets of light emitters. Each of the controllers actuates the light emitters to emit light in a selected pattern. The selected pattern resembles a selected phrase. Thus, the plurality of light emitters may advertise a message.

6 Claims, 5 Drawing Sheets

VISUAL ADVERTISEMENT ASSEMBLY

BACKGROUND OF THE DISCLOSURE

Field of the Disclosure

The disclosure relates to advertisement devices and more particularly pertains to a new advertisement device for communicating a message.

SUMMARY OF THE DISCLOSURE

An embodiment of the disclosure meets the needs presented above by generally comprising a sign that may be displayed. A plurality of light emitters is provided and each of the light emitters is coupled to the sign. Each of the light emitters selectively emits light and the light emitters are arranged into a plurality of sets of light emitters. A plurality of controllers is provided and each of the controllers is coupled to the sign. Each of the controllers is electrically coupled to an associated one of the sets of light emitters. Each of the controllers actuates the light emitters to emit light in a selected pattern. The selected pattern resembles a selected phrase. Thus, the plurality of light emitters may advertise a message.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
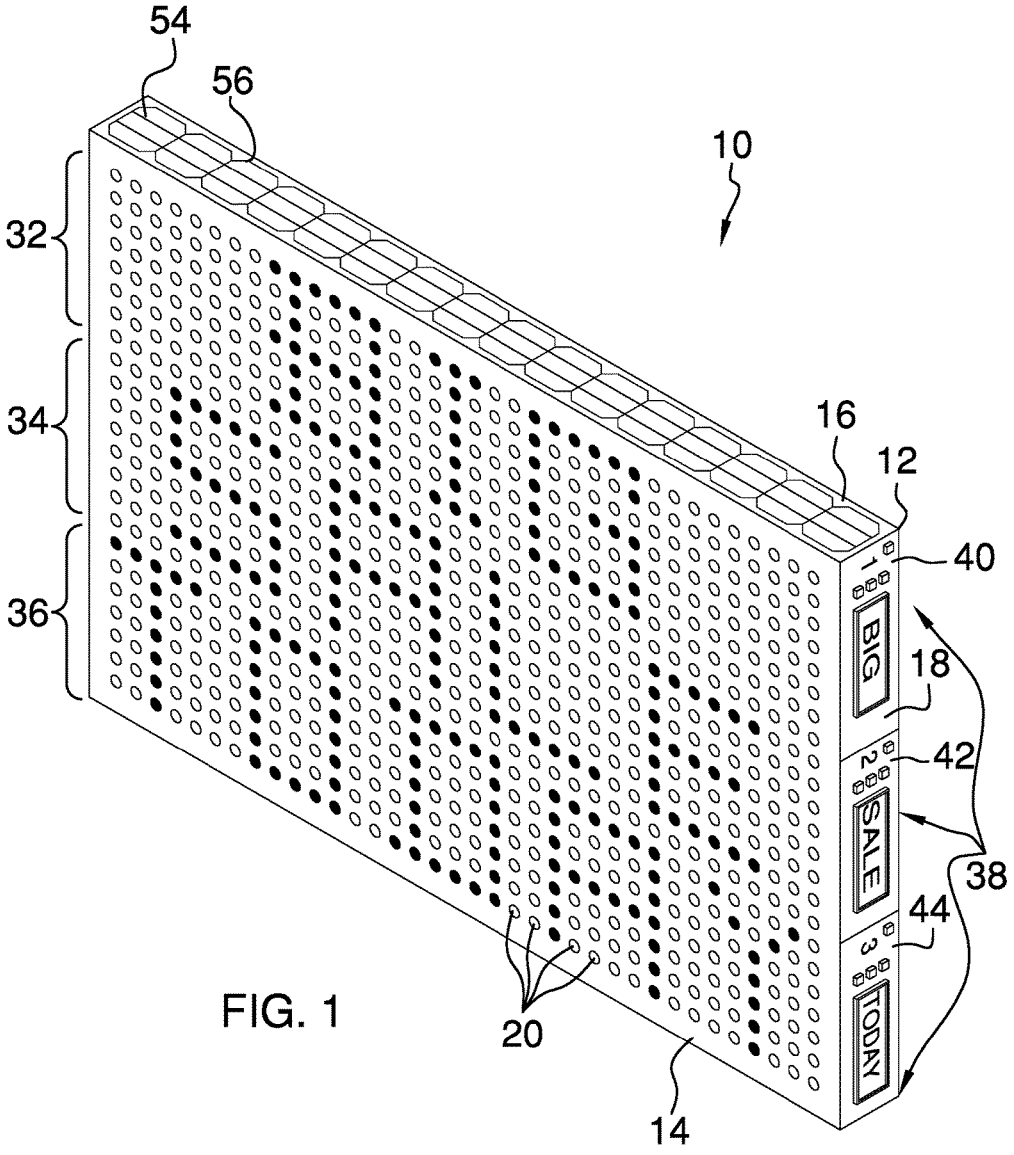
FIG. 1 is a front perspective view of a visual advertisement assembly according to an embodiment of the disclosure.
Figure 2:
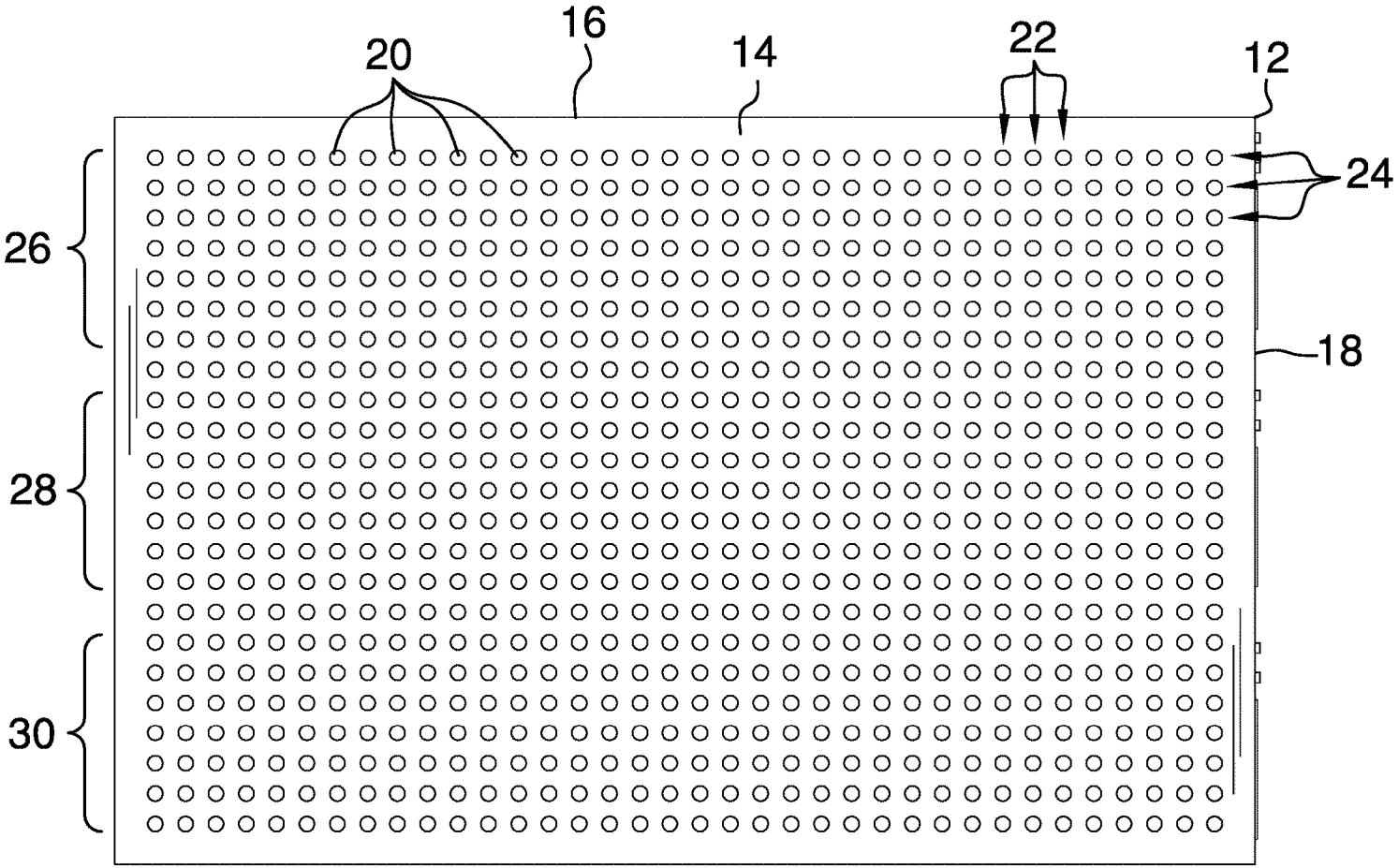
FIG. 2 is a front view of an embodiment of the disclosure.
Figure 3:
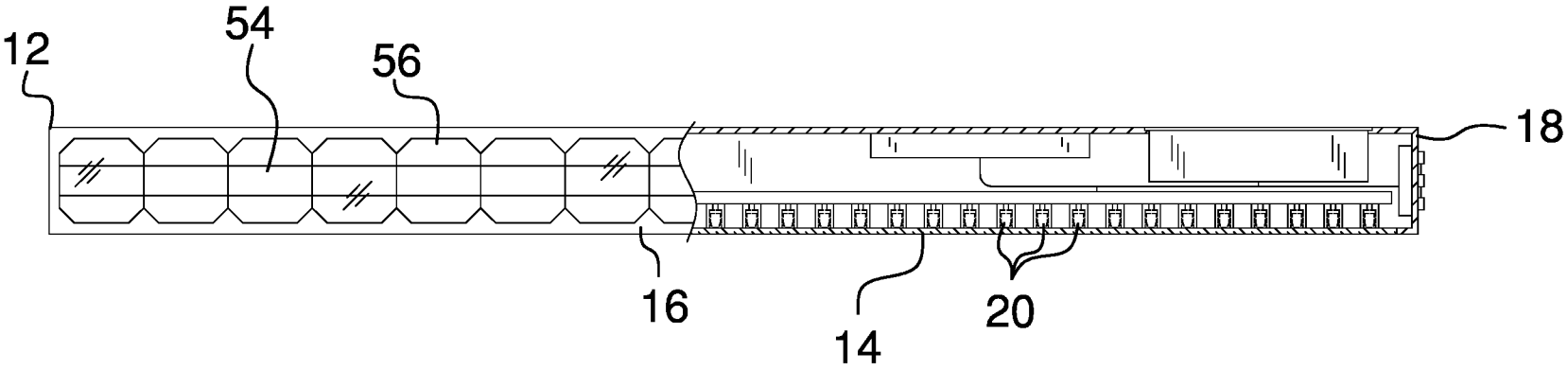
FIG. 3 is a top cut-away view of an embodiment of the disclosure.
Figure 4:
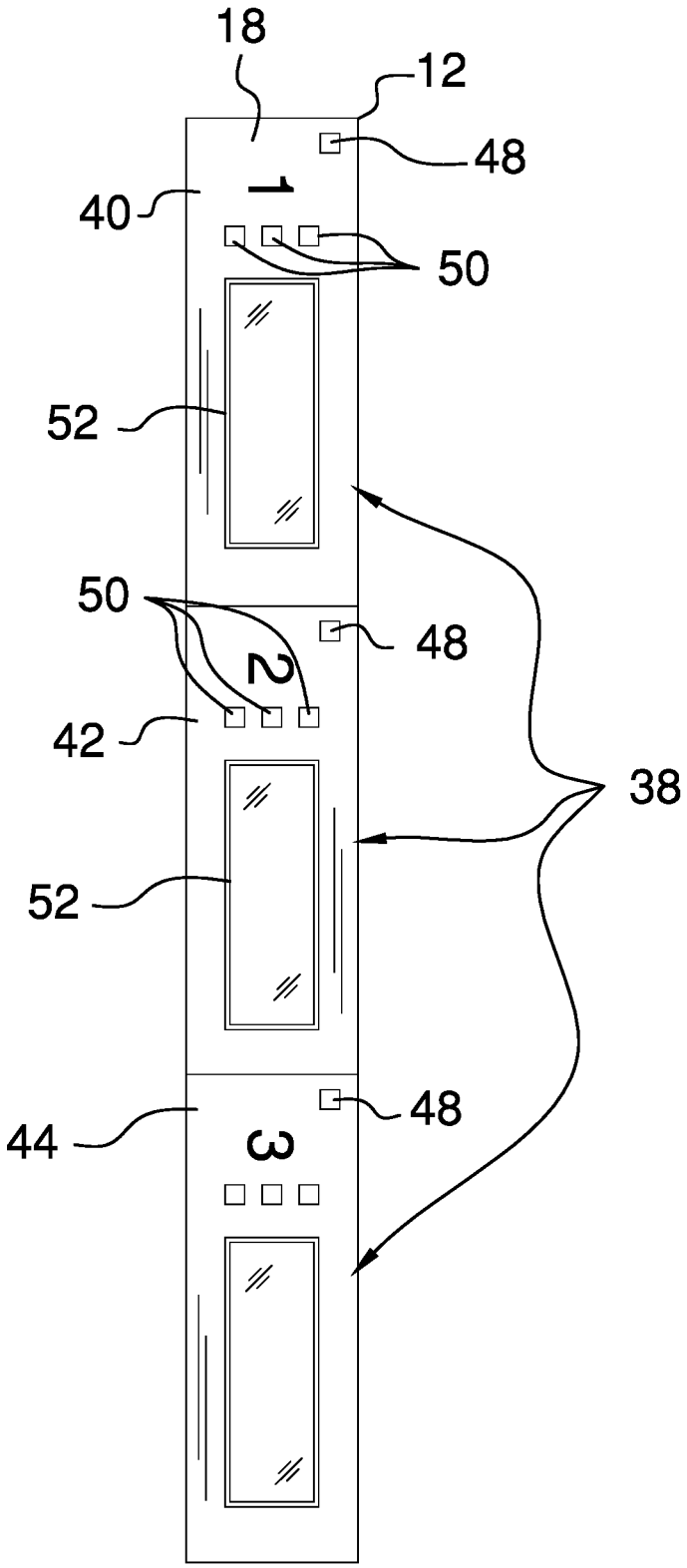
FIG. 4 is a left side view of an embodiment of the disclosure.
Figure 5:
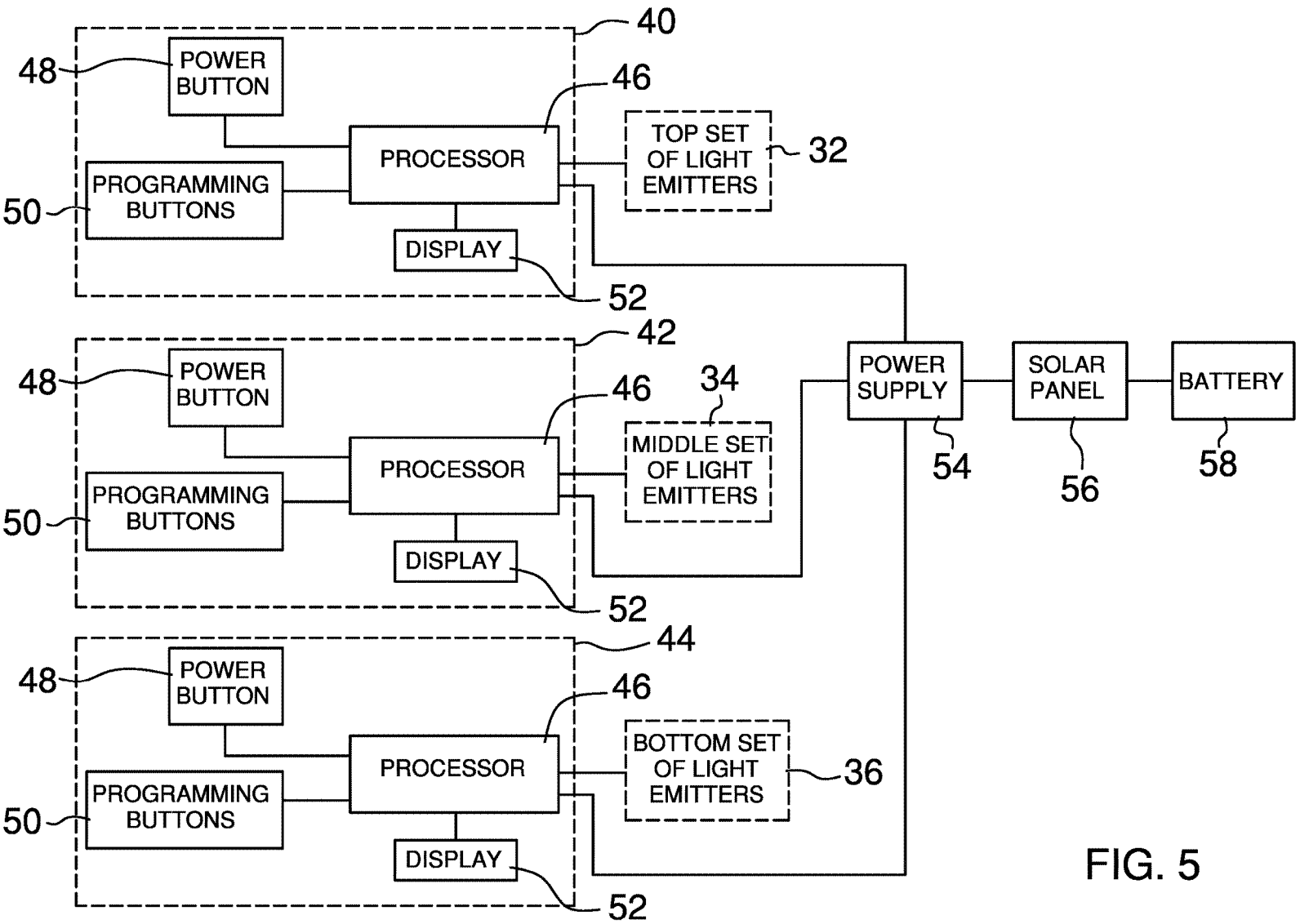
FIG. 5 is a schematic view of an embodiment of the disclosure.

With reference now to the drawings, and in particular to FIGS. 1 through 5 thereof, a new advertisement device embodying the principles and concepts of an embodiment of the disclosure and generally designated by the reference numeral 10 will be described.

As best illustrated in FIGS. 1 through 5, the visual advertisement assembly 10 generally comprises a sign 12 that may be displayed. The sign 12 has a front side 14, a top side 16 and a first lateral side 18. The sign 12 is oriented such that the front side 14 is visible. The sign 12 may be displayed within a store or other location typically used for advertisement purposes.

A plurality of light emitters 20 is provided. Each of the light emitters 20 is coupled to the sign 12 and each of the light emitters 20 selectively emits light. Each of the light emitters 20 is positioned on the front side 14. Thus, each of the light emitters 20 may be observed. Each of the light emitters 20 may comprise an LED or the like. Each of the light emitters 20 emits various colors of light.

The light emitters 20 are arranged into a plurality of columns 22 and rows 24 on the front side 14. The rows 22 comprise a top set of rows 26, a middle set of rows 28 and a bottom set of rows 30. Thus, the light emitters 20 are arranged into a top set of light emitters 32, a middle set of light emitters 34 and a bottom set of light emitters 36.

A plurality of controllers 38 is provided and each of the controllers 38 is coupled to the sign 12. Each of the controllers 38 may be manipulated. Each of the controllers 38 actuates the associated light emitters 20 to emit light in a selected pattern. The selected pattern resembles a selected phrase. Thus, the plurality of light emitters 20 may advertise a message. The controllers 38 include a first controller 40, a second controller 42 and a third controller 44. The first controller 40 is electrically coupled to each of the top set of light emitters 32. The second controller 42 is electrically coupled to each of the middle set of light emitters 34. The third controller 44 is electrically coupled to each of the bottom set of light emitters 36.

Each of the controllers 38 comprises a processor 46 that is electrically coupled to each of the associated light emitters 20. A power button 48 is coupled to the first lateral side 18 of the sign 12. The power button 48 is electrically coupled to the processor 46. The power button 48 turns the processor 46 on and off.

A plurality of programming buttons 50 is provided and each of the programming buttons 50 is coupled to the first lateral side 18 of the sign 12. Each of the programming buttons 50 is electrically coupled to the processor 46. Each of the programming buttons 50 actuates the processor 46 to turn selected ones of the associated light emitters 20 on. Thus, the selected light emitters 20 form the selected phrase.

A display 52 is coupled to the first lateral side 18 of the sign 12. The display 52 is electrically coupled to the processor 46. The display 52 displays the phrase selected with the programming buttons 50. The display 52 may comprise an LCD display or the like. Alternatively, the sign 12 may have a width ranging between 7.0 cm and 13.0 cm thereby facilitating the sign to be worn on a lapel or the like in the convention of a nametag. The display 52 may be programmed to display a first and last name corresponding to a user and a company associated with the user. A pin or the like may be coupled to the sign 12 to engage clothing or the like thereby retaining the sign on the user.

A power supply 54 is coupled to the sign 12. The power supply 54 is electrically coupled to the processor 46 corresponding to each of the controllers 38. The power supply 54 comprises a solar panel 56. The solar panel 56 is positioned on the top side 16 of the sign 12 such that the solar panel 56 is exposed to sunlight or other source of light. The power supply 54 additionally includes a battery 58. The battery 58 is electrically coupled to the solar panel 56. Thus, the solar panel 56 charges the battery 58.

In use, the programming buttons 50 corresponding to the first controller 40 are manipulated. The selected phrase is displayed on the display 52 corresponding to the first controller 40. The top set of light emitters 32 is actuated to display the selected phrase. The programming buttons 50 corresponding to the second controller 42 are manipulated. The selected phrase is displayed on the display 52 corresponding to the second controller 42. The middle set of light emitters 34 is actuated to display the selected phrase. The programming buttons 50 corresponding to the third controller 44 are manipulated. The selected phrase is displayed on the display 52 corresponding to the third controller 44. The bottom set of light emitters 36 is actuated to display the selected phrase.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the phrase "comprising" is used in its non-limiting sense to mean that items following the phrase are included, but items not specifically mentioned are not excluded. A reference to an element by the indefinite article "a" does not exclude the possibility that more than one of the element is present, unless the context clearly requires that there be only one of the elements.

I claim:

1. A visual advertisement assembly comprising:

a sign being configured to be displayed, said sign having a front side, a top side and a first lateral side, said sign being oriented such that said front side is visible;

a plurality of light emitters, each of said light emitters being coupled to said sign such that each of said light emitters is configured to selectively emit light, said light emitters being arranged into a plurality of sets of light emitters, each of said light emitters being positioned on said front side wherein each of said light emitters is configured to be observed, said light emitters being arranged into a plurality of columns and rows on said front side, said plurality of light emitters comprising a top set of light emitters, a middle set of light emitters and a bottom set of light emitters; and a plurality of controllers, each of said controllers being coupled to said sign wherein each of said controllers is configured to be manipulated, each of said controllers being electrically coupled to an associated one of said sets of light emitters, each of said controllers actuating said light emitters to emit light in a selected pattern, said selected pattern resembling a selected phrase wherein said plurality of light emitters is configured to advertise a message.

2. The assembly according to claim 1, wherein each of said controllers comprises:

a processor being electrically coupled to said associated light emitters; and a power button being coupled to a first lateral side of said sign, said power button being electrically coupled to said processor such that said power button turns said processor on and off.

3. The assembly of claim 1, further comprising:

each of said controllers comprising:

a processor being electrically coupled to said associated light emitters, a power button being coupled to said first lateral side of said sign, said power button being electrically coupled to said processor such that said power button turns said processor on and off, a plurality of programming buttons, each of said programming buttons being coupled to said first lateral side of said sign, each of said programming buttons being electrically coupled to said processor, each of said programming buttons actuating said processor to turn selected ones of said associated light emitters on such that said selected light emitters forms the selected phrase, and a display being coupled to said first lateral side of said sign, said display being electrically coupled to said processor, said display displaying the phrase; and a power supply being coupled to said sign, said power supply being electrically coupled to said processor corresponding to each of said controllers, said power supply comprising a solar panel, said solar panel being positioned on said top side of said sign wherein said solar panel is configured to be exposed to sunlight.

4. The assembly according to claim 2, further comprising a plurality of programming buttons, each of said programming buttons being coupled to said first lateral side of said sign, each of said programming buttons being electrically coupled to said processor, each of said programming buttons actuating said processor to turn selected ones of said associated light emitters on such that said selected light emitters forms the selected phrase.

5. A visual advertisement assembly comprising:

a sign being configured to be displayed;

a plurality of light emitters, each of said light emitters being coupled to said sign such that each of said light emitters is configured to selectively emit light, said light emitters being arranged into a plurality of sets of light emitters; and a plurality of controllers, each of said controllers being coupled to said sign wherein each of said controllers is configured to be manipulated, each of said controllers being electrically coupled to an associated one of said sets of light emitters, each of said controllers actuating said light emitters to emit light in a selected pattern, said selected pattern resembling a selected phrase wherein said plurality of light emitters is configured to advertise a message, each of said controllers comprises:

a processor being electrically coupled to said associated light emitters, a power button being coupled to a first lateral side of said sign, said power button being electrically coupled to said processor such that said power button turns said processor on and off, and a display being coupled to said first lateral side of said sign, said display being electrically coupled to said processor, said display displaying the phrase.

6. A visual advertisement assembly comprising:

a sign being configured to be displayed;

a plurality of light emitters, each of said light emitters being coupled to said sign such that each of said light emitters is configured to selectively emit light, said light emitters being arranged into a plurality of sets of light emitters;

a plurality of controllers, each of said controllers being coupled to said sign wherein each of said controllers is configured to be manipulated, each of said controllers being electrically coupled to an associated one of said sets of light emitters, each of said controllers actuating said light emitters to emit light in a selected pattern, said selected pattern resembling a selected phrase wherein said plurality of light emitters is configured to advertise a message, each of said controllers comprises:

a processor being electrically coupled to said associated light emitters, and a power button being coupled to a first lateral side of said sign, said power button being electrically coupled to said processor such that said power button turns said processor on and off; and a power supply being coupled to said sign, said power supply being electrically coupled to said processor corresponding to each of said controllers, said power supply comprising a solar panel, said solar panel being positioned on a top side of said sign wherein said solar panel is configured to be exposed to sunlight.

* * * * *